US006527001B1

(12) United States Patent
Saldan et al.

(10) Patent No.: US 6,527,001 B1
(45) Date of Patent: Mar. 4, 2003

(54) STABILIZING CANE ATTACHMENT

(76) Inventors: Richard Saldan, 2061 Kennedy St., Philadelphia, PA (US) 19124-1563; Margaret L. Saldan, 2061 Kennedy St., Philadelphia, PA (US) 19124-1563

( * ) Notice: Subject to any disclaimer, the term of this patent is extended or adjusted under 35 U.S.C. 154(b) by 0 days.

(21) Appl. No.: 09/881,971

(22) Filed: Jun. 15, 2001

(51) Int. Cl.[7] ..... A45B 9/04

(52) U.S. Cl. ..... 135/82; 135/86; 135/65; 248/155.1; 248/188.9

(58) Field of Search ..... 135/86, 82, 77, 135/78, 65, 66, 911; 248/155, 155.1, 188.9; 24/20 R; D3/7

(56) References Cited

U.S. PATENT DOCUMENTS

| | | | | | |
|---|---|---|---|---|---|
| 909,827 | A | * | 1/1909 | Seibert | 135/84 |
| 2,799,287 | A | * | 7/1957 | Wagner | 135/77 |
| 3,251,372 | A | * | 5/1966 | Smith | 135/86 |
| 3,301,268 | A | | 1/1967 | Tryon | |
| 3,799,180 | A | * | 3/1974 | Weber | 135/25.4 |
| 3,906,971 | A | * | 9/1975 | Burnstine | 135/65 |
| 4,947,882 | A | * | 8/1990 | Levasseur | 135/77 |
| 4,964,430 | A | * | 10/1990 | Janis | 135/67 |
| 4,977,914 | A | | 12/1990 | Smerker | |
| 5,163,710 | A | * | 11/1992 | Chirtel et al. | 135/78 |
| D338,553 | S | | 8/1993 | Flemming | |
| 5,353,825 | A | | 10/1994 | Davis | |
| 5,727,584 | A | * | 3/1998 | Stanec | 135/65 |
| 5,992,434 | A | | 11/1999 | Berlin et al. | |
| 6,003,533 | A | | 12/1999 | Midcap | |
| 6,131,593 | A | * | 10/2000 | Greene et al. | 135/77 |

FOREIGN PATENT DOCUMENTS

| | | | | |
|---|---|---|---|---|
| FR | 2587204 | * | 3/1987 | 135/65 |

* cited by examiner

*Primary Examiner*—Lanna Mai
*Assistant Examiner*—Winnie Yip

(57) ABSTRACT

A stabilizing cane attachment for supporting a user upon sandy and snow covered surfaces. The stabilizing cane attachment includes a support member having a bore extending therethrough and being adapted mount at a bottom end portion of a cane; and also includes a first stopper member being adapted to securely attach about the cane above the support member to prevent the support member from coming off the cane; and further includes a second stopper member being adapted to securely attach about a bottom end of the cane.

7 Claims, 1 Drawing Sheet

STABILIZING CANE ATTACHMENT

BACKGROUND OF THE INVENTION

1. Field of the Invention

The present invention relates to a walking aid attachment for a cane and more particularly pertains to a new stabilizing cane attachment for supporting a user upon sandy and snow covered surfaces.

2. Description of the Prior Art

The use of a walking aid attachment for a cane is known in the prior art. More specifically, a walking aid attachment for a cane heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,899,771; U.S. Pat. No. 5,307,828; U.S. Pat. No. Des. 359,162; U.S. Pat. No. 3,467,117; U.S. Pat. No. 2,192,040; and U.S. Pat. No. 5,433,234.

While these devices fulfill their respective, particular objectives and requirements, the aforementioned patents do not disclose a new stabilizing cane attachment. The inventive device includes a support member having a bore extending therethrough and being adapted mount at a bottom end portion of a cane; and also includes a first stopper member being adapted to securely attach about the cane above the support member to prevent the support member from coming off the cane; and further includes a second stopper member being adapted to securely attach about a bottom end of the cane.

In these respects, the stabilizing cane attachment according to the present invention substantially departs from the conventional concepts and designs of the prior art, and in so doing provides an apparatus primarily developed for the purpose of supporting a user upon sandy and snow covered surfaces.

SUMMARY OF THE INVENTION

In view of the foregoing disadvantages inherent in the known types of walking aid attachment for a cane now present in the prior art, the present invention provides a new stabilizing cane attachment construction wherein the same can be utilized for supporting a user upon sandy and snow covered surfaces.

The general purpose of the present invention, which will be described subsequently in greater detail, is to provide a new stabilizing cane attachment which has many of the advantages of the walking aid attachment for a cane mentioned heretofore and many novel features that result in a new stabilizing cane attachment which is not anticipated, rendered obvious, suggested, or even implied by any of the prior art walking aid attachment for a cane, either alone or in any combination thereof.

To attain this, the present invention generally comprises a support member having a bore extending therethrough and being adapted mount at a bottom end portion of a cane; and also includes a first stopper member being adapted to securely attach about the cane above the support member to prevent the support member from coming off the cane; and further includes a second stopper member being adapted to securely attach about a bottom end of the cane.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stabilizing cane attachment which has many of the advantages of the walking aid attachment for a cane mentioned heretofore and many novel features that result in a new stabilizing cane attachment which is not anticipated, rendered obvious, suggested, or even implied by any of the prior art walking aid attachment for a cane, either alone or in any combination thereof.

It is another object of the present invention to provide a new stabilizing cane attachment which may be easily and efficiently manufactured and marketed.

It is a further object of the present invention to provide a new stabilizing cane attachment which is of a durable and reliable construction.

An even further object of the present invention is to provide a new stabilizing cane attachment which is susceptible of a low cost of manufacture with regard to both materials and labor, and which accordingly is then susceptible of low prices of sale to the consuming public, thereby making such stabilizing cane attachment economically available to the buying public.

Still yet another object of the present invention is to provide a new stabilizing cane attachment which provides in the apparatuses and methods of the prior art some of the advantages thereof, while simultaneously overcoming some of the disadvantages normally associated therewith.

Still another object of the present invention is to provide a new stabilizing cane attachment for supporting a user upon sandy and snow covered surfaces.

Yet another object of the present invention is to provide a new stabilizing cane attachment which includes a support member having a bore extending therethrough and being adapted mount at a bottom end portion of a cane; and also includes a first stopper member being adapted to securely attach about the cane above the support member to prevent the support member from coming off the cane; and further includes a second stopper member being adapted to securely attach about a bottom end of the cane.

Still yet another object of the present invention is to provide a new stabilizing cane attachment that is easily and conveniently attached to the bottom end portion of a conventional walking cane.

Even still another object of the present invention is to provide a new stabilizing cane attachment that provides greater surface area to prevent a user from slipping with the walking cane on sandy and snow covered surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
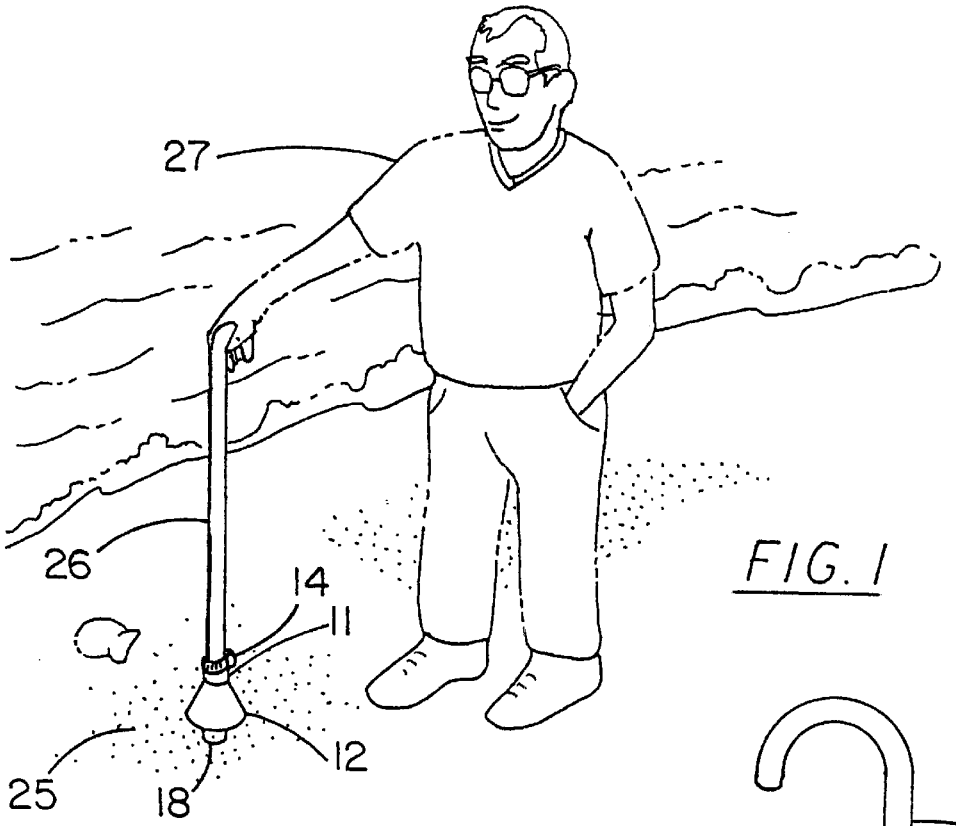
FIG. 1 is a perspective view of a new stabilizing cane attachment according to the present invention and shown in use.
Figure 3:
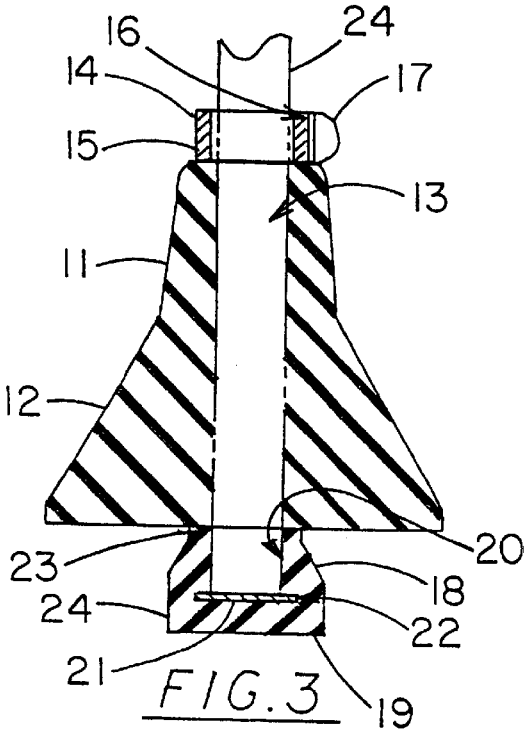
FIG. 3 is a side elevational view of the present invention.
Figure 2:
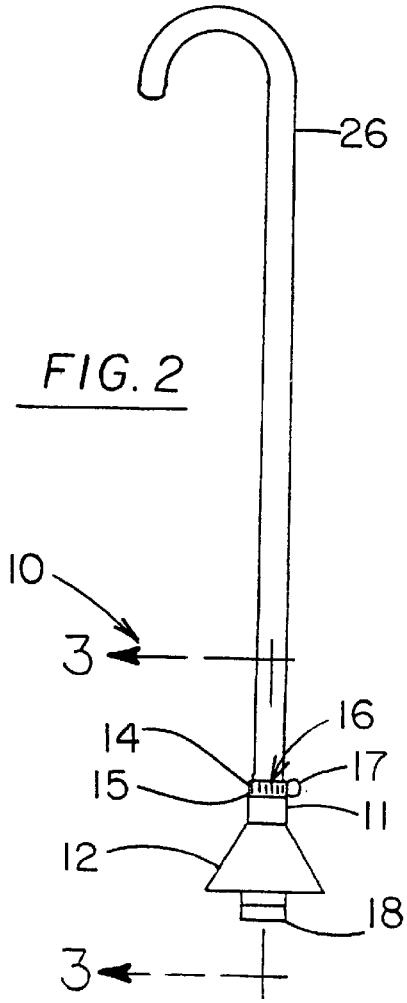
FIG. 2 is a cross-sectional view of the present invention.

With reference now to the drawings, and in particular to FIGS. 1 through 3 thereof, a new stabilizing cane attachment embodying the principles and concepts of the present invention and generally designated by the reference numeral 10 will be described.

As best illustrated in FIGS. 1 through 3, the stabilizing cane attachment 10 generally comprises a support member 11 having a bore 13 extending therethrough and being adapted mount at a bottom end portion of a cane 26 with the cane 26 being received through the bore 13. The support member 11 is conical shaped and has a flared base portion 12 with the support member 11 having a length of approximately 4 to 5 inches with the base portion 12 having a diameter of approximately 5¼ inches. A first stopper member 14 is adapted to securely and conventionally attach about the cane 26 above the support member 11 to prevent the support member 1I1 from coming off the cane 26. The first stopper member 14 is a hose-clamp 14 having a ring member 15 with a plurality of slots 16 being spaced apart and being laterally disposed along a length of the ring member 15. The hose-clamp 14 also has a fastening member 17 for adjustably tightening the ring member 15 about the cane 26.

A second stopper member 18 is adapted to securely and conventionally attach about a bottom end of the cane 26. The second stopper member 18 includes a rubberized over-shoe member being adapted to mount about the bottom end of the cane 26 with the over-shoe member including a bottom 19 and a bore 20 extending through a top thereof and terminating in the over-shoe member. The second stopper member 18 also includes an annular groove 22 being disposed in a wall defining the bore 20 of the second stopper member 18 and being disposed at a base of the bore 20 of the second stopper member 18. A washer member 21 is securely disposed in the annular groove 22 of the over-shoe member and is adapted to fasten about the bottom end of the cane 26 to prevent the support member 11 from coming off the cane 26. The over-shoe member has an upper portion 23 and an enlarged lower portion 24 for being in contactable relationship with a ground surface.

In use, the user 27 is able to more easily walk on unsteady ground surfaces 25 such as sandy beaches and snow-covered ground surfaces without slipping and falling down since the support member 11 and the second stopper member 18 provides a much ground surface area than the bottom end of a conventional cane 26 thus providing stability to the cane 26 and to the user 27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A stabilizing cane attachment comprising:

a support member having a bore extending therethrough for receiving a bottom end portion of a cane with the cane being received therethrough said bore, said bore having a longitudinal axis, said support member having a substantially circular bottom surface extending in a plane oriented substantially perpendicular to the longitudinal axis of said bore;

a first stopper member for attaching about the cane above said support member to prevent said support member from moving along the cane away from the bottom end portion of the cane; and a second stopper member having a bore extending therein for receiving a bottom end of the cane, said bore having a longitudinal axis, the second stopper member having a substantially circular bottom surface extending in a plane oriented substantially, perpendicular to the longitudinal axis of said bore; of said second stopper member wherein a diameter of said bottom surface of said support member being approximately greater than a diameter of said bottom surface of said second stopper member, said second stopper member is securely mounted bellow said support member, and an upper surface of said second stopper member is engaged with said bottom surface of the support member.

2. A stabilizing cane attachment as described in claim 1, wherein said support member is substantially conically-shaped having a flare base portion.

3. A stabilizing cane attachment as described in claim 1, wherein said first stopper member is a hose-clamp having a ring member with a plurality of slots being spaced apart and being laterally disposed along a length of said ring member, said hose-clamp also having a fastening member for adjustably tightening said ring member about the cane.

4. A stabilizing cane attachment as described in claim 1, wherein said second stopper member includes a rubberized over-shoe member for mounting about the bottom end of the cane, said over-shoe member including a bottom, said bore extending through a top of said over-shoe member and terminating in said over-shoe member, said second stopper member also including an annular groove being disposed in a wall defining said bore of said second stopper member and being disposed at a base of said bore of said second stopper member, a washer member being disposed in said annular groove of said over-shoe member.

5. A stabilizing cane attachment as described in claim 4, wherein said over-shoe member has an upper portion and an enlarged lower portion for contacting a ground surface to provide greater stability for the user upon unsteady ground surfaces.

6. A stabilizing cane attachment comprising:

a support member having a bore extending therethrough and being adapted to be mounted at a bottom end portion of a cane with the cane being received in and through said bore, said support member being conical shaped having a flared base portion, said support member having a length of approximately 4 to 5 inches with said base portion having a diameter of approximately 5¼ inches;

a first stopper member being adapted to securely attach about the cane above said support member to prevent said support member from coming off the cane, said first stopper member being a hose-clamp having a ring member with a plurality of slots being spaced apart and being laterally disposed along a length of said ring member, said hose-clamp also having a fastening member for adjustably tightening said ring member about the cane; and a second stopper member being securely mounted below said support member and adapted to securely attach about a bottom end of the cane, said second stopper member including a rubberized over-shoe member being adapted to mount about the bottom end of the cane, said over-shoe member including a bottom and a bore extending through a top thereof and terminating in said over-shoe member, said second stopper member including an annular groove being disposed in a wall defining said bore of said second stopper member and being disposed at a base of said bore of said second stopper member, and further including a washer member being securely disposed in said annular groove of said over-shoe member and being adapted to fasten about the bottom end of the cane to prevent said support member from coming off the cane, said over-shoe member having an upper portion contacting with said flared base portion of said support member and an enlarged lower portion for being in contactable relationship with a ground surface to provide greater stability for the user upon unsteady ground surfaces.

7. A stabilizing cane attachment comprising:

a support member having a bore extending therethrough for receiving a bottom end portion of a cane with the cane being received therethrough said bore said support member being conical shaped having a flared base portion;

a first stopper member for attaching about the cane above said support member to prevent said support member from coming off the cane, said first stopper member being a hose-clamp having a ring member with a plurality of slots being spaced apart and being laterally disposed along a length of said ring member, said hose-clamp also having a fastening member for adjustably tightening said ring member about the cane; and a second stopper member being securely mounted below said support member for attaching about a bottom end of the cane, said second stopper member including an elastomeric over-shoe member being adapted to mount about the bottom end of the cane, said over-shoe member including a bottom and a bore extending through a top thereof and terminating in said over-shoe member, said second stopper member including an annular groove being disposed in a wall defining said bore of said second stopper member and being disposed at a base of said bore of said second stopper member, and further including a washer member being securely disposed in said annular groove of said over-shoe member and being adapted to fasten about the bottom end of the cane to prevent said support member from coming off the cane, said over-shoe member having an upper portion contacting with said flared base portion of said support member and an enlarged lower portion for being in contactable relationship with a ground surface to provide greater stability for the user upon unsteady ground surfaces.

* * * * *